US008696980B2

(12) United States Patent
Nazmy et al.

(10) Patent No.: US 8,696,980 B2
(45) Date of Patent: Apr. 15, 2014

(54) NICKEL-BASE SUPERALLOY WITH IMPROVED DEGRADATION BEHAVIOR

(75) Inventors: Mohamed Nazmy, Fislisbach (CH); Claus Paul Gerdes, Baden-Ruetihof (CH); Andreas Kuenzler, Baden (CH)

(73) Assignee: Alstom Technology Ltd, Baden (CH)

( * ) Notice: Subject to any disclaimer, the term of this patent is extended or adjusted under 35 U.S.C. 154(b) by 223 days.

(21) Appl. No.: 13/020,093

(22) Filed: Feb. 3, 2011

(65) Prior Publication Data

US 2011/0194972 A1 Aug. 11, 2011

(30) Foreign Application Priority Data

Feb. 5, 2010 (CH) ..... 0142/10

(51) Int. Cl.
*C22C 19/05* (2006.01)

(52) U.S. Cl.
USPC ..... 420/444

(58) Field of Classification Search
USPC ..... 420/444
See application file for complete search history.

(56) References Cited

U.S. PATENT DOCUMENTS 4,643,782 A 2/1987 Harris
4,683,119 A * 7/1987 Selman et al. ..... 420/444
4,719,080 A 1/1988 Duhl
4,764,225 A * 8/1988 Shankar et al. ..... 148/404
5,270,123 A 12/1993 Walston
5,435,861 A 7/1995 Khan
2004/0005238 A1 1/2004 Arrell

FOREIGN PATENT DOCUMENTS

EP 0208645 A2 1/1987
EP 0555124 A1 8/1993
EP 1359231 B1 11/2003
EP 1 795 621 A1 6/2007
GB 2234521 A 2/1991

OTHER PUBLICATIONS

Pessah-Simonetti, P. Caron and T. Khan: *Effect of long-term prior aging on tensile behaviour of high-performance single crystal superalloy*, Journal de Physique IV, Colloque C7, vol. 3, Nov. 1993.
Nov. 25, 2013 Chinese Office Action issued in Chinese Application No. 201110052881.8.

* cited by examiner

*Primary Examiner* — Jessee Roe
(74) *Attorney, Agent, or Firm* — Buchanan Ingersoll & Rooney PC

(57) ABSTRACT

A nickel-base superalloy with improved degradation behavior consists essentially of the following chemical composition (details in % by weight): 7.7-8.3 Cr, 5.0-5.25 Co, 2.0-2.1 Mo, 7.8-8.3 W, 5.8-6.1 Ta, 4.9-5.1 Al, 1.3-1.4 Ti, 0.1-0.6 Pt, 0.1-0.5 Nb, 0.11-0.15 Si, 0.11-0.15 Hf, 200-750 ppm C, 50-400 ppm B, and the remainder Ni and production-related impurities.

18 Claims, 3 Drawing Sheets

NICKEL-BASE SUPERALLOY WITH IMPROVED DEGRADATION BEHAVIOR

CROSS-REFERENCE TO PRIOR APPLICATIONS

Priority is claimed to Swiss Application No. CH 00142/10, filed Feb. 5, 2010, the entire disclosure of which is hereby incorporated by reference herein.

FIELD

The invention relates generally to the field of materials science, and particularly to a nickel-base superalloy for the production of single-crystal components (SX alloy) or components with a directionally solidified microstructure (DS alloy), such as for example blades or vanes for gas turbines, which is distinguished by improved degradation behavior.

BACKGROUND OF THE INVENTION

Nickel-base superalloys are known. Single-crystal components made from these alloys have a very good material strength at high temperatures. This allows, for example, the intake temperature of gas turbines to be increased, with the result that the efficiency of the gas turbine rises.

Nickel-base superalloys for single-crystal components, as are described in, for example, U.S. Pat. No. 4,643,782, EP 0 208 645 and U.S. Pat. No. 5,270,123, for this purpose contain alloying elements which strengthen the solid solution, for example Re, W, Mo, Co, Cr, and elements which form γ' phases, for example Al, Ta and Ti. The level of high-melting alloying elements (W, Mo, Re) in the basic matrix (austenitic γ phase) increases continuously as the temperature of load on the alloy increases. For example, standard nickel-base superalloys for single crystals contain 6-8% W, up to 6% Re and up to 2% Mo (details in % by weight). The alloys disclosed in the abovementioned documents have a high creep strength, good LCF (low cycle fatigue) and HCF (high cycle fatigue) properties and a high resistance to oxidation.

These known alloys were developed for aircraft turbines and were therefore optimized for short-term and medium-term use, i.e. the load time was designed for up to 20,000 hours. By contrast, industrial gas turbine components have to be designed for a load time of up to 75,000 hours.

By way of example, after a load time of 300 hours, the alloy CMSX-4 which is described in U.S. Pat. No. 4,643,782, when it was tested for use in a gas turbine at a temperature of over 1000° C., underwent considerable coarsening of the γ' phase, which disadvantageously leads to an increase in the creep rate of the alloy.

It is also necessary to improve the resistance of the known alloys to oxidation at very high temperatures. By way of example, U.S. Pat. No. 4,719,080 discloses that the addition of Pt, Pd, Ru and Os has a positive effect on an increase in the resistance of the single-crystal superalloys described in said document to oxidation and corrosion, where the overall content of these elements should lie in a very wide range of 0-10% by weight.

A further problem of the known nickel-base superalloys, for example the alloys which described in U.S. Pat. No. 5,435,861, is that in the case of large components, e.g. gas turbine blades or vanes with a length of more than 80 mm, the casting properties leave something to be desired. The casting of a perfect, relatively large directionally solidified single-crystal component from a nickel-base superalloy is extremely difficult, since most of these components have defects, e.g. small-angle grain boundaries, freckles (i.e. defects caused by a series of identically directed grains with a high eutectic content), equiaxed limits of variation, microporosities, etc. These defects weaken the components at high temperatures, and consequently the desired service life or operating temperature of the turbine are not achieved. However, since a perfectly cast single-crystal component is extremely expensive, the industry tends to permit as many defects as possible without the service life or operating temperature being adversely affected.

One of the most common defects is grain boundaries, which are particularly harmful to the high-temperature properties of the single-crystal components. Whereas in small components small-angle grain boundaries are relatively rare, they are highly relevant to the casting properties, the mechanical properties and the oxidation behavior of large SX or DS components at high temperatures.

Grain boundaries are regions with a high local disorder of the crystal lattice, since the neighboring grains collide in these regions, and therefore there is a certain misorientation between the crystal lattices. The greater the misorientation, the greater the disorder, i.e. the greater the number of dislocations in the grain boundaries which are required for the two grains to fit together. This disorder is directly related to the behavior of the material at high temperatures. It weakens the material if the temperature rises to above the equicohesive temperature (=0.5×melting point in K).

This effect is described in GB 2 234 521 A. For example, in a conventional nickel-base single-crystal alloy, at a test temperature of 871° C., the fracture strength drops greatly if the misorientation of the grains is greater than 6°. This has also been confirmed in single-crystal components with a directionally solidified microstructure, and consequently the viewpoint has generally been that misorientations of greater than 6° are unacceptable.

It is also described in the above-referenced GB 2 234 521 A that enriching nickel-base superalloys with boron or carbon during a directional solidification produces microstructures which have an equiaxed or prismatic grain structure. Carbon and boron strengthen the grain boundaries, since C and B cause the precipitation of carbides and borides at the grain boundaries, and these compounds are stable at high temperatures. Moreover, the presence of these elements in and along the grain boundaries reduces the diffusion process, which is a primary cause of the grain boundary weakness. It is therefore possible to increase the misorientations to 10° to 12° yet still achieve good materials properties at high temperatures. However, these small-angle grain boundaries have an adverse effect on the properties in particular of large single-crystal components formed from nickel-base superalloys.

EP 1 359 231 B1 discloses a nickel-base superalloy for the production of single-crystal components, which has improved casting properties and a higher resistance to oxidation than the abovementioned alloys and is characterized by the following chemical composition (details in % by weight):

7.7-8.3 Cr
5.0-5.25 Co
2.0-2.1 Mo
7.8-8.3 W
5.8-6.1 Ta
4.9-5.1 Al
1.3-1.4 Ti
0.11-0.15 Si
0.11-0.15 Hf
200-750 ppm C
50-400 ppm B
remainder nickel and production-related impurities.

After the casting process, superalloys of this type are subjected to heat treatment, in which, in a first solution annealing step, the γ' phase which is precipitated nonuniformly during the casting process is completely or partially dissolved in the microstructure. In a second heat-treatment step, this phase is precipitated in a controlled manner again. In order to obtain optimal properties, this precipitation heat treatment is carried out in such a way that fine, uniformly distributed particles of the γ' phase are produced in the γ phase (=matrix).

It has been found that targeted coarsening of the γ' particles, the phenomenon known as rafting, occurs in the microstructure of alloys of this type if a mechanical load is present with long-term high-temperature loading (creep loading), or after plastic deformation of the material, which is followed by high-temperature loading of the material. At high γ' contents (i.e. at a γ' content of at least 50% by volume), the microstructure is inverted, i.e. γ' becomes the continuous phase in which what was previously the γ matrix is embedded. A change in structure of this type is also brought about by plastic deformation of the superalloy, which is followed by heat treatment (high-temperature annealing).

Since the intermetallic γ' phase tends toward environmental embrittlement, under certain loading conditions this subsequently leads to a massive drop in the mechanical properties, in particular the yield strength, at room temperature (25° C.) compared to samples which were not subjected to such prior creep loading. This impairment of the yield strength is described by the term "degradation" of the properties (see Pessah-Simonetti, P. Caron and T. Khan: Effect of long-term prior aging on tensile behaviour of high-performance single crystal superalloy, Journal de Physique IV, Colloque C7, Volume 3, November 1993).

However, if the tensile test is carried out at high test temperatures, for example 950° C., instead of at room temperature, this difference between the materials subjected to different loading with respect to the yield strength and the ductility does not arise or arises rarely.

SUMMARY OF THE INVENTION

An aspect of the invention is to avoid the above-mentioned disadvantages. In an embodiment, the present invention provides a nickel-base superalloy of the type described above, which is distinguished by improved degradation behavior, i.e. the highest possible (residual) strength/hardness is subsequently present at room temperature after long-term mechanical loading at high temperatures.

According to an embodiment of the present invention, the nickel-base superalloy with improved degradation behavior consists essentially of the following chemical composition (details in % by weight):

7.7-8.3 Cr
5.0-5.25 Co
2.0-2.1 Mo
7.8-8.3 W
5.8-6.1 Ta
4.9-5.1 Al
1.3-1.4 Ti
0.1-0.6 Pt
0.1-0.5 Nb
0.11-0.15 Si
0.11-0.15 Hf
200-750 ppm C
50-400 ppm B
remainder nickel and production-related impurities.

The advantages of this embodiment of the present invention are that this alloy has the very good properties (good casting properties, good resistance to oxidation at high temperatures, good creep rupture strength) of the alloy described in EP 1 359 231 B1, but in addition does not experience a drop in yield strength at room temperature after prior high-temperature creep loading, i.e. has good degradation behavior.

In an embodiment of the present invention, it is particularly advantageous if the alloy consists essentially of the following composition (details in % by weight):

7.7-8.3 Cr
5.0-5.25 Co
2.0-2.1 Mo
7.8-8.3 W
5.8-6.1 Ta
4.9-5.1 Al
1.3-1.4 Ti
0.1-0.5 Pt
0.1-0.2 Nb
0.11-0.15 Si
0.11-0.15 Hf
200-300 ppm C
50-100 ppm B
remainder nickel and production-related impurities.

One alloy according to a preferred embodiment of the present invention, consists essentially of the following chemical composition (details in % by weight):

8 Cr
5 Co
2 Mo
8 W
6 Ta
5 Al
1.4 Ti
0.5 Pt
0.2 Nb
0.1 Si
0.1 Hf
200 ppm C
80 ppm B
remainder nickel and production-related impurities.

This alloy is eminently suitable for the production of large single-crystal components, for example blades or vanes for gas turbines.

BRIEF DESCRIPTION OF THE DRAWINGS

The drawings show an exemplary embodiment of the invention. The invention is not limited to the exemplary embodiment. Other features and advantages of various embodiments of the present invention will become apparent by reading the following detailed description with reference to the attached drawings which illustrate the following.

DETAILED DESCRIPTION

The invention is explained in more detail below with reference to an exemplary embodiment and FIGS. 1 to 3.

Nickel-base superalloys having the chemical composition given in table 1 were investigated (details in % by weight):

TABLE 1

Chemical composition of the alloys investigated

| | Comparative alloy (VL) | Alloy according to the invention (L) |
|---|---|---|
| Ni | Remainder | Remainder |
| Cr | 8 | 8 |
| Co | 5 | 5 |
| Mo | 2 | 2 |
| W | 8 | 8 |
| Ta | 6 | 6 |
| Al | 5 | 5 |
| Ti | 1.4 | 1.4 |
| Pt | — | 0.5 |
| Nb | — | 0.2 |
| Si | 0.1 | 0.1 |
| B | 0.008 | 0.008 |
| C | 0.02 | 0.02 |
| Hf | 0.1 | 0.1 |

The alloy L is a nickel-base superalloy for single-crystal components, the composition of which is covered by the patent claim of the present invention and which represents a particularly preferred embodiment variant. The comparative alloy VL is known from the prior art (EP 1 359 231 B1) and differs from the alloy according to the invention in that it is not alloyed with Pt and Nb.

Carbon and boron strengthen the grain boundaries, in particular also the small-angle grain boundaries which occur in the <001> direction in SX or DS gas turbine blades or vanes made from nickel-base superalloys, since these elements cause the precipitation of carbides and borides at the grain boundaries, and these compounds are stable at high temperatures. Moreover, the presence of these elements in and along the grain boundaries reduces the diffusion process, which is a primary cause of the grain boundary weakness. This considerably improves the casting properties of long single-crystal components, for example gas turbine blades or vanes with a length of about 200 to 230 mm.

The addition of 0.11 to 0.15% by weight Si, preferably 0.1%, in particular in combination with Hf in approximately the same order of magnitude, significantly improves the resistance to oxidation at high temperatures compared to previously known nickel-base superalloys.

Platinum and niobium are elements which, according to the present invention, are added in controlled, small amounts (Pt: 0.1-0.6, preferably 0.5% by weight, Nb: 0.1-0.5, preferably 0.2% by weight) to the alloy known from EP 1 359 231 B1 (with corresponding reduction of the residual content of Ni). These two elements influence the extent of the lattice offset between the γ' phase and the γ phase, which in turn is responsible for the morphological changes in the phases and the residual strength of the material after nickel-base single-crystal superalloys have been subjected to high-temperature creep loading. The microalloying with Pt and Nb within the stated limits has the effect that the lattice offset between the γ' phase and the γ phase is about zero at high temperatures. This means that the tendency of the γ' phase toward rafting is reduced or even suppressed, i.e. the γ' phase remains spherical.

Figure 1A:
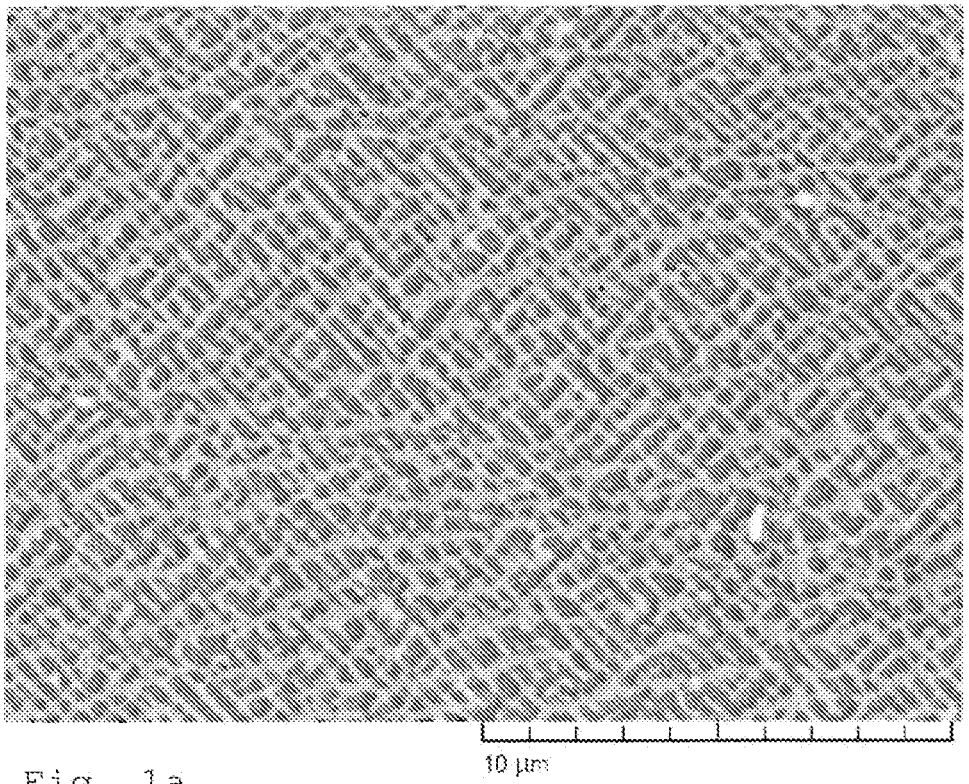
FIG. 1 shows two micrographs illustrating the microstructure of the comparative alloy a) in the initial state, and b) after cold-rolling and subsequent high-temperature treatment at 1050° C./204 h.
Figure 2A:
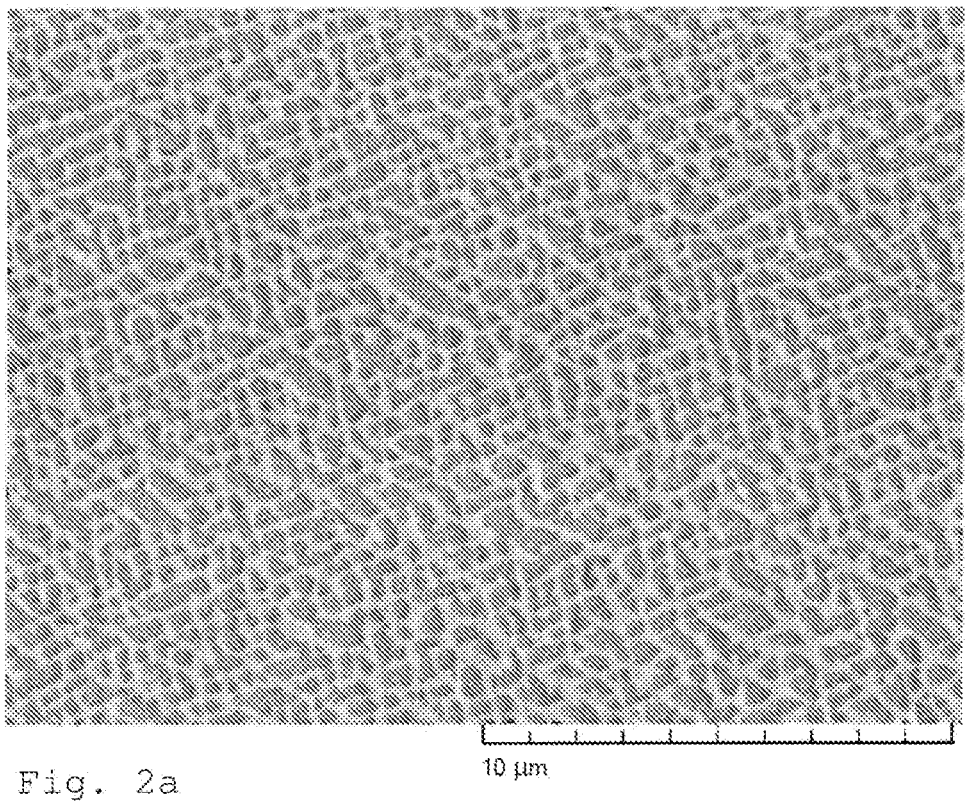
FIG. 2 shows two micrographs illustrating the microstructure of the alloy according to an embodiment of the invention a) in the initial state, and b) after cold-rolling and subsequent high-temperature treatment at 1050° C./204 h.

This can readily be seen by comparing the microstructure formation of the two alloys. FIG. 1*a* shows the microstructure of the comparative alloy VL and FIG. 2*a* shows the microstructure of the alloy L according to the invention in the initial state. The γ' phase is uniformly distributed in the matrix (γ phase) in both samples and has a roughly spherical form.

Figure 1B:
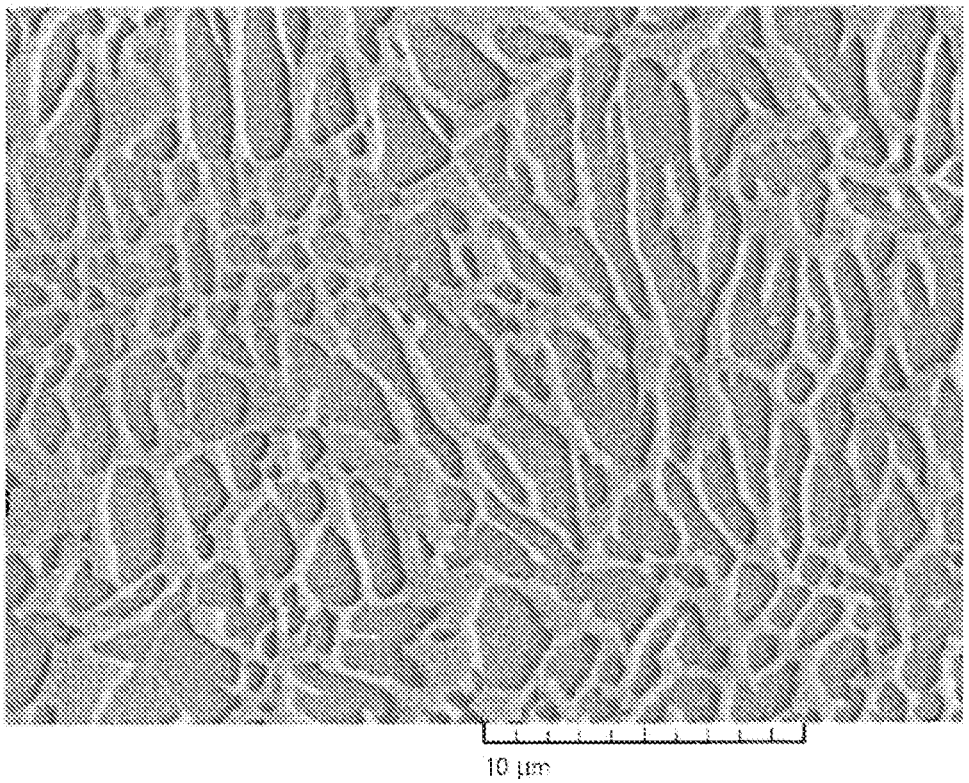
Figure 2B:
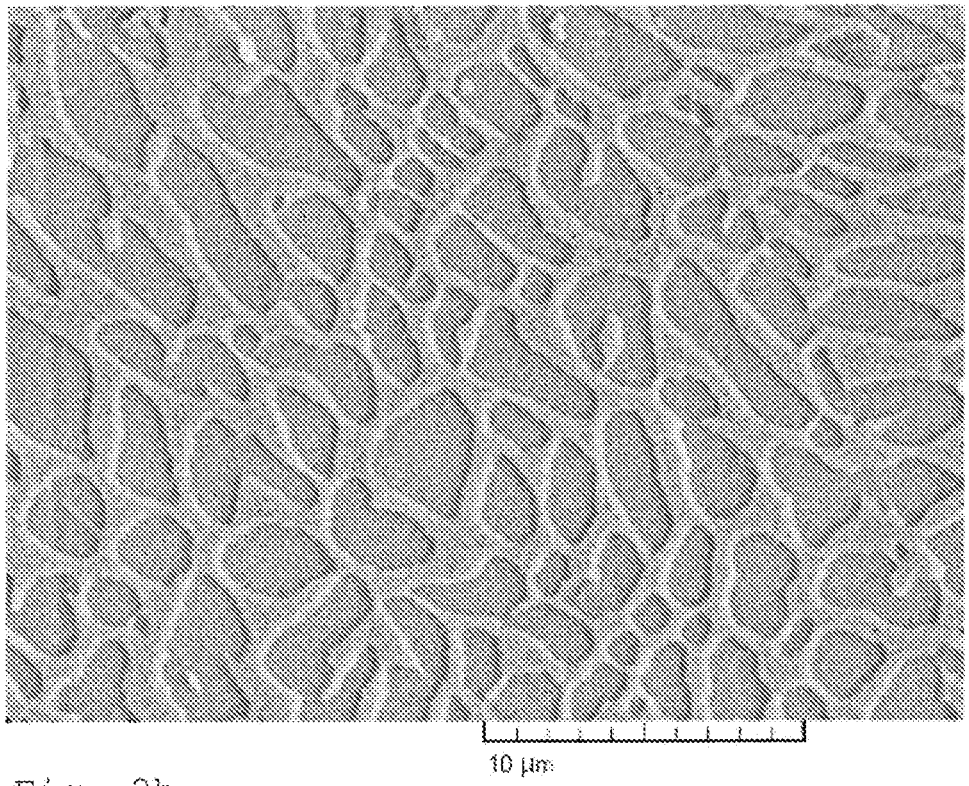

By contrast, FIG. 1*b* and FIG. 2*b* show the microstructure for the comparative alloy (FIG. 1*b*) and the alloy according to the invention (FIG. 2*b*) after cold-forming (cold-rolling) and subsequent age-hardening treatment at high temperatures with the following parameters: 1050° C./204 h.

The rafting of the γ' phase of the comparative alloy can clearly be seen in FIG. 1*b*, since, compared to the initial state, the γ' phase has firstly coarsened and secondly stretched in a preferred direction.

By contrast, FIG. 2*b* shows that although the γ' phase of the alloy according to the invention is likewise coarsened compared to the initial state, no rafting or only very weak rafting of the γ' phase has occurred here.

Figure 3:
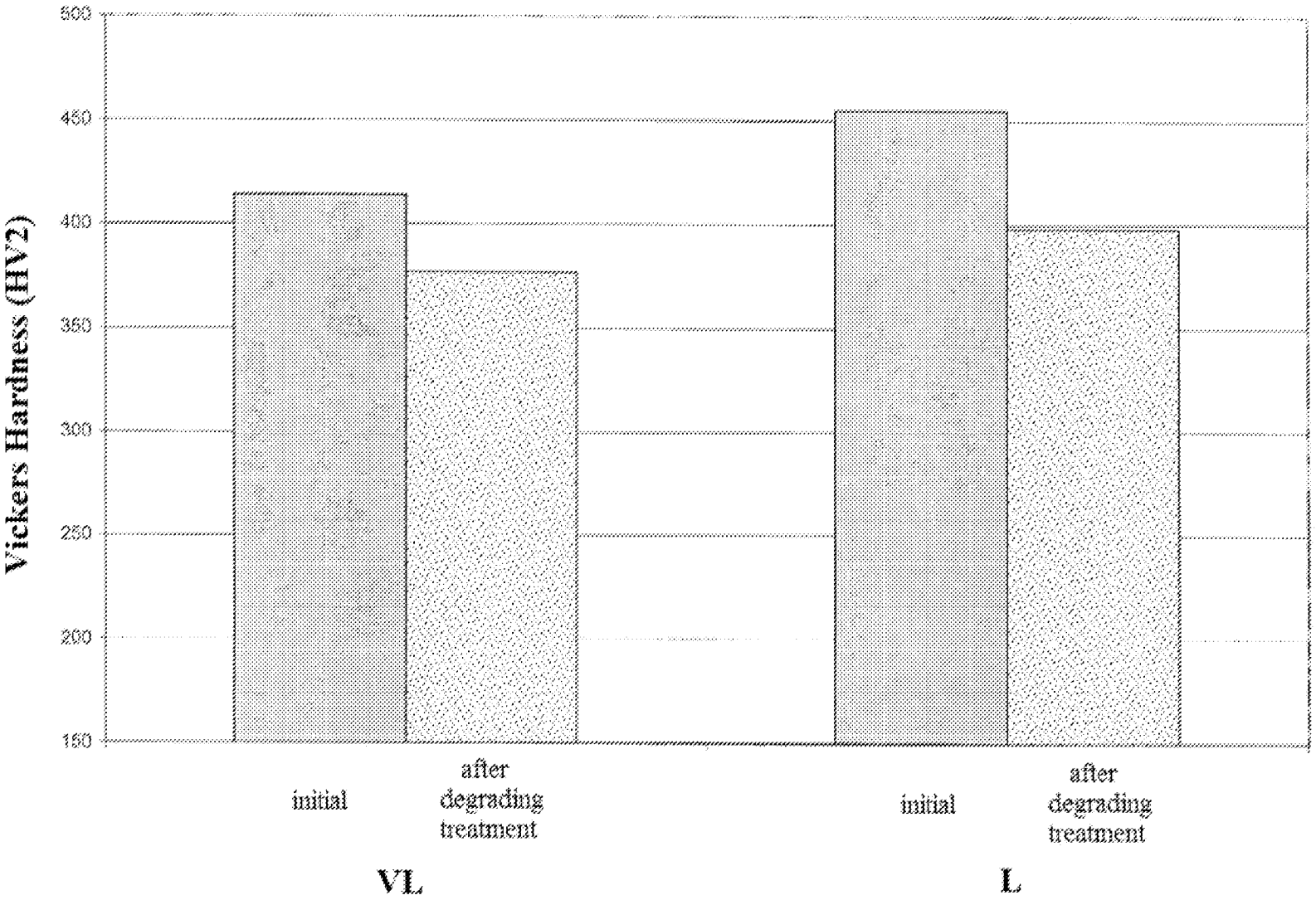
FIG. 3 shows the hardness as a function of the respective state of the microstructure of the comparative alloy VL and of the alloy L according to an embodiment of the invention.

FIG. 3 clearly shows the effect of this different microstructure formation, which has been caused by the addition of small amounts of Pt and Nb, on the properties at room temperature.

FIG. 3 shows a graph plotting the Vickers hardness at room temperature as a function of the respective state of the microstructure of the comparative alloy VL and of the alloy L according to the invention according to FIGS. 1*a*) and 1*b*) and also 2*a*) and 2*b*). The respective hardness HV2 of the initial state is shown on the left and the hardness HV2 after treatment of the material under degrading conditions (cold-rolling and annealing at 1050° C./204 h) is shown on the right.

In both cases, it can be seen that the alloy according to the invention is superior.

In the initial state, the hardness HV2 of the alloy according to the invention is about 10% better than that of the comparative alloy. Although the hardness HV2 measured at room temperature is lower, as expected, compared to the respective initial state of the two alloys after the (degradation) treatment, in the case of the alloy L according to the invention it is still more than 5% higher than in the case of the comparative alloy VL.

While the invention has been particularly shown and described with reference to preferred embodiments thereof, it will be understood by those skilled in the art that various changes in form and details may be made therein without departing from the spirit and scope of the invention.

The invention claimed is:

1. A nickel-base superalloy, consisting of, in % by weight;
7.7-8.3 Cr;
5.0-5.25 Co;
2.0-2.1 Mo;
7.8-8.3 W;
5.8-6.1 Ta;
4.9-5.1 Al;
1.3-1.4 Ti;
0.1-0.6 Pt;
0.1-0.5 Nb;
0.11-0.15 Si:
0.11-0.15 Hf;
200-750 ppm C;
50-400 ppm B, and
remainder nickel and production-related impurities,
wherein the alloy does not, experience a drop in yield strength at room temperature after prior high-temperature creep loading.

2. A single-crystal component, comprising the super alloy of claim 1.

3. The superalloy of claim 1, having a Vickers hardness 5% greater than an alloy lacking Pt and Nb, after a degradation treatment cold-rolling and annealing at 1050° C. for 204 hours.

4. The superalloy of claim 1, having 0.1 to 0.5 wt. % Pt.

5. The superalloy of claim 1, having 0.1 to 0.2 wt. % Nb.

6. The superalloy of claim 1, having 0.1 wt. % Pt.

7. The superalloy of claim 1, having 1.4 wt. % Ti.

8. The superalloy of claim 1, having 0.5 wt. % Pt.

9. The superalloy of claim 1, having 0.2 wt. % Nb.

10. The superalloy of claim 1, having 200-300 ppm C.

11. The superalloy of claim 1, having 200 ppm C.

12. A gas turbine blade or vane, comprising the superalloy of claim 1.

13. The gas turbine blade of claim 12, having a length of 200 to 230 mm.

14. The gas turbine vane of claim 12, having a length of 200 to 230 mm.

15. The superalloy of claim 1, having, in % by weight:

0.1-0.5 Pt;

0.1-0.2 Nb;

200-300 ppm C; and 50-100 ppm B.

16. A single-crystal component, comprising the super alloy of claim 15.

17. The superalloy of claim 15, having, in % by weight:

8 Cr;

5 Co;

2 Mo;

8 W;

6 Ta;

5 Al;

1.4 Ti;

0.5 Pt;

0.2 Nb;

200 ppm C; and 80 ppm B.

18. The superalloy of claim 17, having 0.12 wt. % Si; and 0.12 wt. % Hf.

* * * * *